United States Patent [19]

May

[11] Patent Number: 4,800,700

[45] Date of Patent: Jan. 31, 1989

[54] METHOD AND APPARATUS FOR LIFTING AND SUPPORTING SLABS

[75] Inventor: Donald R. May, Independence, Mo.

[73] Assignee: Atlas System, Inc., Independence, Mo.

[21] Appl. No.: 46,850

[22] Filed: May 7, 1987

[51] Int. Cl.[4] ..... E04B 1/00

[52] U.S. Cl. ..... 52/742; 52/125.1

[58] Field of Search ..... 52/170, 298, 726, 742, 52/125.1; 405/230

[56] References Cited

U.S. PATENT DOCUMENTS

| | | | |
|---|---|---|---|
| 3,685,301 | 8/1972 | Heacox . | |
| 3,796,055 | 3/1974 | Mahony . | |
| 3,902,326 | 9/1975 | Langenbach, Jr. . | |
| 4,058,952 | 11/1977 | Donnelly | 52/125.1 X |
| 4,070,867 | 6/1978 | Cassidy . | |
| 4,634,319 | 1/1987 | May . | |
| 4,673,315 | 6/1987 | Shaw et al. | 405/230 |

OTHER PUBLICATIONS

Undated literature articles entitled, "The Magnum Pier" and The Slab Jack System.

*Primary Examiner*—Carl D. Friedman
*Assistant Examiner*—Creighton Smith
*Attorney, Agent, or Firm*—Hovey, Williams, Timmons & Collins

[57] ABSTRACT

A method of lifting and supporting concrete slabs which includes the steps of cutting an access hole in the slab, inserting a lift plate through the access hole; rotating and drawing the lift plate up against the underside of the slab, and driving a pier through the access hole to bedrock or other load bearing strata. After a series of piers are driven, lifting means are then attached to the lift plates and therefore the slab and employed to raise the slab to the desired level. The lift plates are then secured to the piers to maintain the slab in its desired, permanent position. The apparatus for carrying out the foregoing method includes a lift plate below and engaging the bottom of the slab, a pier driven through an access hole cut in the slab and through a hole in the lift plate, a lift bracket over the slab and secured to the lift plate by threaded rods extending through the slab, and an extensible ram positioned between the pier and the lift bracket for raising the lift plate and therefore the slab to its final, desired position.

9 Claims, 2 Drawing Sheets

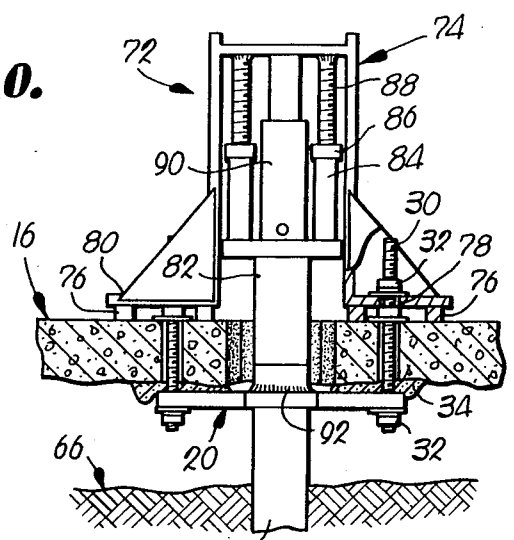
Fig. 3.
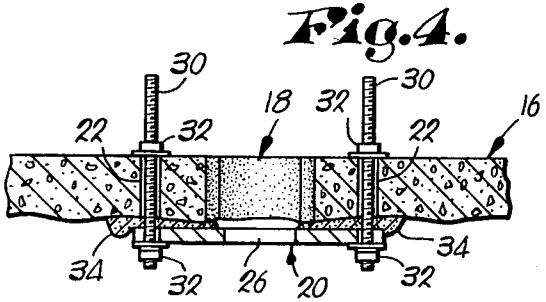
Fig. 4.
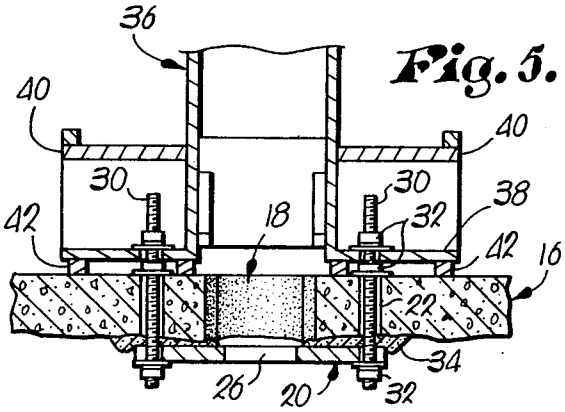
Fig. 5.
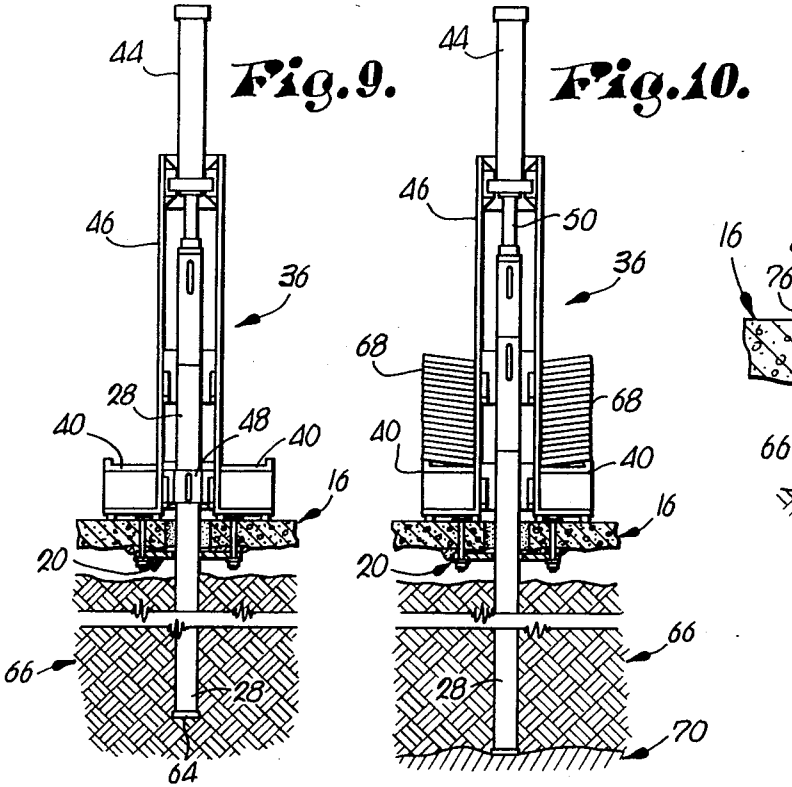
Fig. 9.
Fig. 10.
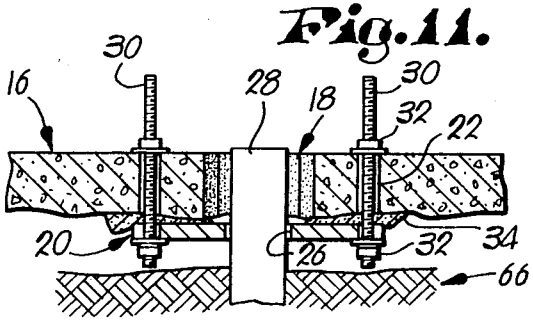
Fig. 11.
Fig. 14.
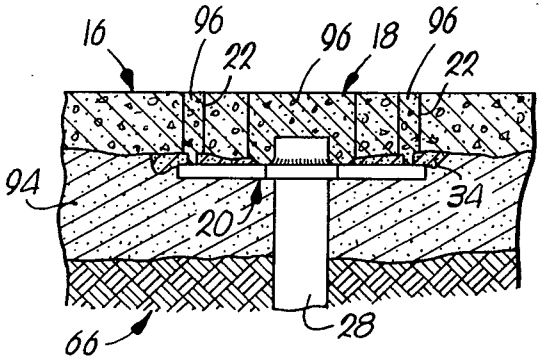
Fig. 15.

METHOD AND APPARATUS FOR LIFTING AND SUPPORTING SLABS

FIELD OF THE INVENTION

A method and apparatus is provided to lift and support a structure, particularly a building with a concrete slab floor, which may have settled from its original desired position and needs to be righted or leveled to cure cracks and other structural defects which may have occurred as a result of the settlement. The method and apparatus are employed from within the structure to be lifted with minimal disruption of the interior and permit the slab floor and structure to be lifted to a desired position and supported permanently by a plurality of piers which have been driven beneath the structure whereby the load of the structure is carried on top of a plurality of individually driven piers.

Background of the Invention

This invention consists of a method and apparatus utilized to lift and support structures which may have settled from their original position. The apparatus is portable and designed to be used in the interior of a structure and therefore may be used year-round in most climates. Inasmuch as it is designed to be employed in the interior of the structure, no earthmoving or other heavy equipment is required which might damage adjacent property. It is particularly adapted for structures constructed on a concrete slab floor.

The method involves cutting an access hole in the floor; a lift plate, preferably of steel, is then inserted through the access hole, rotated, and drawn up against the bottom of the floor by fastening nuts beneath the plate and above the floor on threaded rods extending above and below the floor slab. Individually and one at a time, piers are driven through access holes cut in the floor slab of the structure. The piers are driven to bedrock or to a strata of sufficient load bearing capability to carry the weight of the structure. The piers are preferably made of mill rolled galvanized steel.

After the piers have been driven, a lift bracket assembly is placed over each of the piers and attached to the lift plate by the threaded rods. The floor slab may be lifted and adjusted by extending rams placed between the lift brackets and the piers. Once the slab is in the desired, lifted position, the plates are secured to the piers and the lift brackets removed, permitting the access holes to be filled and the floor restored to use.

It can thus be appreciated that the invention permits the structure to be permanently supported on piers without brackets or other hardware being visible or extending above the top surface of the slab. The apparatus and method can be employed on slabs of any or varying thickness. In addition, it may be employed to correct concrete slab floors which have settled and cracked internally without resorting to excavation. It may be employed on structures with slab floors of large square footage which cannot be supported solely from the perimeter of the slab by such apparatus and methods as disclosed in U.S. Pat. No. 3,796,055, issued Mar. 12, 1974 and U.S. Pat. No. 4,634,319, issued Jan. 7, 1987. By employing a plurality of rams and lifting brackets in unison, as opposed to each acting individually, as disclosed in U.S. Pat. No. 3,902,326 issued Sept. 2, 1975, the slab may be lifted uniformly and with a minimum of stress. Finally, the invention may be employed in conjunction with other methods such as those described above to support a structure both beneath and around the perimeter of the slab.

SUMMARY OF THE INVENTION

The invention consists of a method and an apparatus for lifting and supporting structures. The apparatus includes a lift plate located beneath the slab floor of the structure and drawn up against the slab by nuts on threaded rods. Attached to the top of the threaded rods is a lift bracket. The lift bracket is located over a pier driven through a hole in the lift plate to bedrock. An extensible ram is located between the lift bracket and the pier in order to raise the slab to the desired level.

The method is carried out by cutting an access hole in the slab floor of the structure; inserting a lift plate through the access hole and drawing it up against the underside of the slab; driving a pier through the access hole into the soil to bedrock; cutting off the pier a distance above the bottom of the slab corresponding to the amount of lift desired at that location; attaching a lift bracket to the lift plate by threaded rods extending through the slab; inserting an extensible ram between the pier and the lift bracket; activating the ram to raise the slab to the desired position; and securing the lift plate to the pier to support the structure in its desired and permanent position.

DESCRIPTION OF THE DRAWINGS

FIG. 3 is a fragmentary side elevational view showing the attachment of the lift plate to the slab using threaded rods;

FIG. 4 is a fragmentary side elevational view similar to FIG. 3 showing the step of tightening of the lift plate against the slab and the insertion of grout between the lift plate and the slab;

FIG. 5 is a fragmentary, side elevation similar to FIG. 4 showing the positioning of he pier driving assembly on the slab over the lift plate;

FIG. 9 is a front elevational view showing the entire assembly during the pier driving operation;

FIG. 10 is a front elevational view similar to FIG. 9 showing the conclusion of the pier driving operation;

FIG. 11 is a view of the slab after removal of the pier driving assembly and shortening of the pier prior to lifting;

FIG. 14 is a fragmentary side elevational view showing the attachment of the lift bracket assembly at the conclusion of the lifting operation; and FIG. 15 is a side elevational view showing the finished pier and slab.

DESCRIPTION OF THE PREFERRED EMBODIMENT

Figures 1, 2, 6, 7, 8, 12, 13:
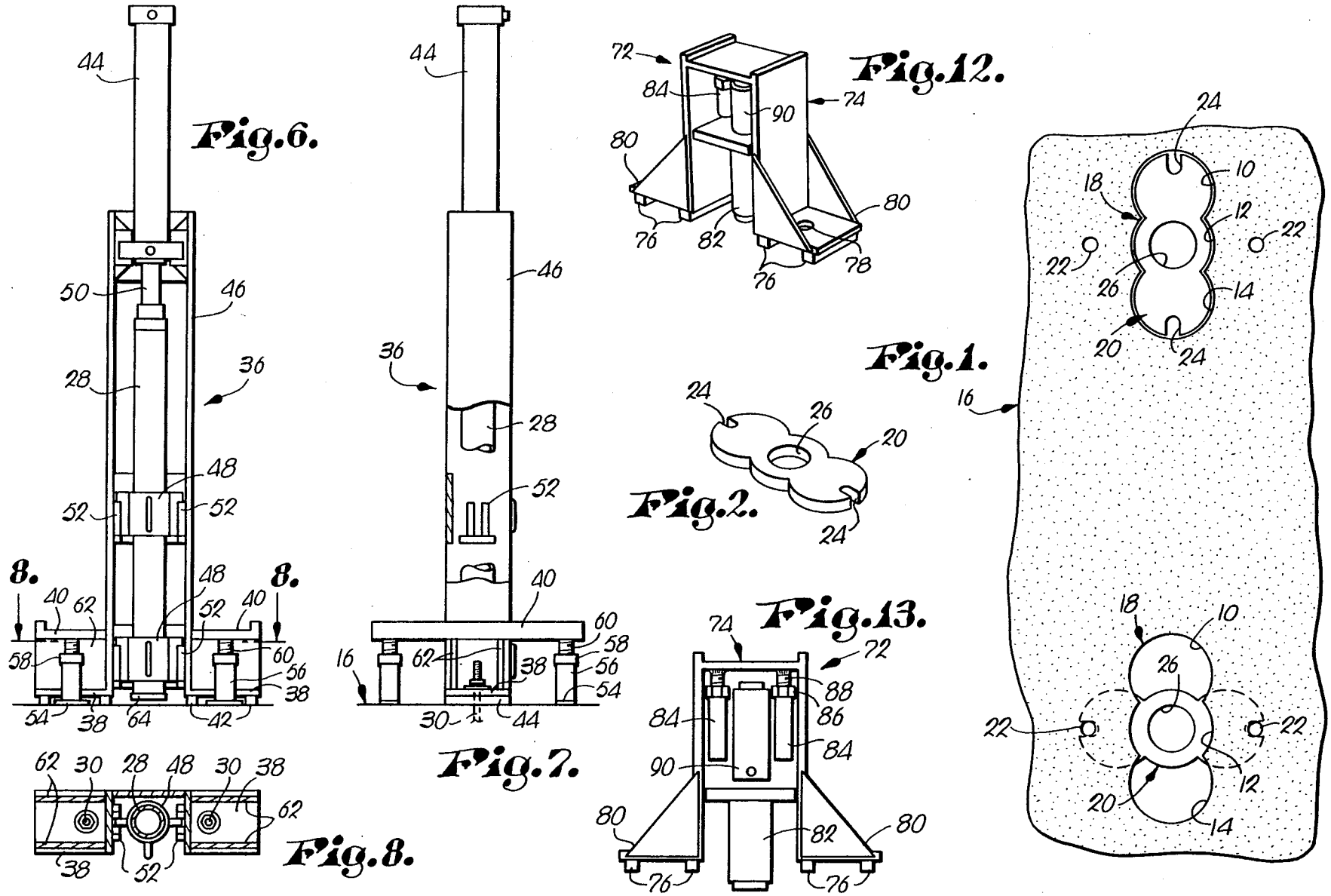
FIG. 1 is a top plan view of a slab showing insertion of the lift plate through the access hole and alignment beneath the slab after insertion.
FIG. 2 is a perspective view of the lift plate.
FIG. 6 is a front elevational view showing the pier driving assembly.
FIG. 7 is a side elevational view of the pier driving assembly as shown in FIG. 6 with a portion of both the tower and pier cut away to show the sleeve bracket.
FIG 8 is a sectional view of the pier driving assembly on line 8—8 of FIG. 6.
FIG. 12 is a perspective view of the lift bracket assembly.
FIG. 13 is a front elevational view of the lift bracket assembly.

The method and apparatus hereinafter described in detail are intended for use in lifting and supporting any structure or building with a concrete slab floor foundation which has settled or needs to be lifted and then supported in a fixed and desired position.

To lift and level a slab floor, a series of overlapping holes 10, 12 and 14 are first cut in a slab 16 as shown in FIG. 1. Typically, these holes are cut with a conventional 7" diamond core drill bit but may be of other dimensions or cut by other means as the circumstances on the site and available equipment dictate. The three overlapping holes form an extended-figure-eight access hole 18 which corresponds to but is slightly larger than a lift plate 20. Two smaller rod holes 22 are drilled through the slab 16 at right angles to the longitudinal axis of the access hole 18. These rod holes 22 are spaced away from the perimeter of the access hole 18 a distance to correspond with the location of notches 24 on the lift plate 20 after it is inserted through the access hole 18 and rotated 90°, as shown in the lower portion of FIG. 1.

As is shown in FIG. 2, the lift plate 20 is also preferably of an extended-figure-eight configuration corresponding to but slightly smaller than the access hole 18. The center of the lift plate 20 is provided with a bushing hole 26 to permit piers 28 to pass through the lift plate 20. Each end of the lift plate 20 is provided with a notch 24 to permit threaded rods 30 to pass through and thereafter secure the lift plate 20 beneath the slab 16 by a conventional washer and rod nut 32 tightened on the threaded rod 30, as shown by FIG. 3.

Following attachment of the rod nuts 32 on the threaded rods 30, both above the slab 16 and beneath the lift plate 20, high strength grout 34 is placed between the slab 16 and the lift plate 20 to ensure an even and uniform contact between the slab 16 and lift plate 20. The rod nuts 32 are then tightened to draw the lift plate 20 and high strength grout 34 into contact with the slab 16, all as shown by FIG. 4. No further steps are taken until the high strength grout 34 is dry.

After the high strength grout 34 has dried, the pier driving assembly 36 is placed over the threaded rods 30 which pass through holes in the wing base 38 as shown in FIG. 5. The wings 40, and therefore the pier driving assembly 36, are supported by feet 42 of a sufficient height to permit clearance of any conventional washers and the rod nut 32 between the slab 16 and the wing base 38.

The pier driving assembly 36 has as its general components a drive cylinder 44, a tower 46, wings 40 and sleeves 48. The tower 46 and wings 40 may be of unitary construction as shown in FIGS. 6 and 7 or assembled from components on the site. The drive cylinder 44 is mounted atop the tower 16 and is hydraulically operated in the preferred embodiment. It will be appreciated that any drive means may be substituted such as, for example, an electric screw drive or pneumatic hammer. Force from the drive cylinder 44 is applied to a pier 28 through a plunger 50. A pier 28 is guided down the tower 46 and through the slab 16 by sleeves 48. The sleeves 48 are removably mounted on sleeve mounting brackets 52 to permit the loading of additional piers 28 into the tower 46.

Support for the pier driving assembly 36 is provided by wings 40 which rest on legs 54. Stability is accomplished by wing supports 56. The wing supports 56 may be adjusted by support nut 58 and stud 60 to ensure the tower 46 and thus the piers 28 remain vertical and are adequately stabilized. The wings 40 are also supported by wing walls 62.

As may be seen in FIG. 8, the piers 28 are cylinders. In the preferred embodiment, steel is used because of its price, durability, strength and ease of welding. The dimensions of the pier 28 may vary according to the application, but 3½ inch outside diameter ¼ inch wall thickness piers 28 are used in the preferred embodiment. Typically these piers 28 would be treated and/or coated to resist corrosion. The first pier 28 to be driven is fitted with a friction reduction collar 64 on its lower end after it clears the bushing hole 26 of the lift plate 20 to ease its passage through the soil 66 as shown in FIG. 9.

Piers 28 are added and driven into the soil 66 as indicated by FIG. 9 until the slab 16 begins to lift. At that point, weights 68 are placed on the wings 40 of the pier driving assembly 36 as shown in FIG. 10. In the preferred embodiment, approximately five thousand pounds of weights 68 are added. Additional piers are driven until the slab 16 and the pier driving assembly 36 lift again. This indicates the pier 28 has reached bedrock 70 or other load bearing strata sufficient to support the pier 28 and slab 16.

The pier driving assembly 36 is then removed from the threaded rods 30. The last pier 28 is severed at a point above the bottom of the slab 16 equivalent to the amount of lift desired for that site of the slab 16. For example, if the slab 16 is four inches thick and six inches of lift are needed at that location, the pier 28 would be severed at a point two inches above the top of the slab 16.

Thereafter, a lift bracket assembly 72 is employed to lift the slab 16. Lift bracket 74 is placed over pier 28. Feet 74 on the base of the lift bracket 74 provide clearance for the rod nuts 32 with the threaded rods 30 passing through mounting holes 78 in extension 80 and secured by a conventional washer and rod nut 32.

FIGS. 12 and 13 show the components of the lift bracket assembly 72. Lifting foot 82 is spaced away from the top of the lift bracket 74 by a pair of collars 84 welded to nuts 86 and threadably secured on adjusting studs 88. A hydraulically operated ram 90 is inserted between the top of lift bracket 74 and lifting foot 82. The ram 90 is then activated and extends, thereby raising lift bracket 74 which is bolted to lift plate 20 and therefore the slab 16.

Once the slab 16 and lift plate 20 rise to the desired level, collars 84 are extended on adjusting studs 88 to permit removal of ram 90. A weld 92 is employed to join lift plate 20 at the bushing hole 26 to the pier 28 and thereby support slab 16, as shown in FIG. 14, on the pier 28.

Thereafter, the lift bracket assembly 72 and threaded rods 30 are removed. FIG. 15 shows the finished slab 16 with pressure grout 94 injected between the soil 66 and the slab 16 and rod holes 22 and access hole 18 filled with cement 96 to floor level.

It will be appreciated that a number of piers 28 would be employed to lift a slab 16 with the thickness of the slab 16 determining the spacing of the piers 28. Pier placement can be roughly gauged by spacing them one foot apart for each inch thickness of the slab 16. By employing hydraulic rams 90, a number of such rams may be connected to a manifold and activated simultaneously by a single pump to raise the slab 16 uniformly and avoid stressing and cracking the slab 16. By using a manifold with valves for each ram 90, the amount of lift may be tuned to permit simultaneous raising of a tilted slab 16 by multiple lift bracket assemblies 74 to a desired, level position.

Because the piers 28 are driven to bedrock 70 and welded to the lift plate 20, the support for the structure is permanent. By injecting pressure grout 94 beneath the raised slab 16, it is further supported and maintained in its permanent position. While the description provided has mentioned a specific application to concrete slab foundations, it may be readily appreciated that this method and apparatus may be used on any type of floor or foundation which has settlement problems with sufficient strength to permit supporting it by piers or plates.

I claim:

1. A method of lifting and supporting a slab comprising the steps of:

cutting an access hole through the slab;

inserting a lift plate through the access hole and rotating it to permit engagement with lower face of the slab;

mounting a pier driving assembly over said access hole;

driving a pier through said hole to a position where said pier can ultimately support said slab;

successively and individually inserting additional lift plates through other access holes cut in the slab and driving additional piers for supporting said slab;

removing said pier driving assembly;

placing a lift bracket assembly on each of the piers;

attaching each of said lift bracket assemblies to a corresponding lift plate, raising the lift plates and therefore the slab to a desired position, securing said lift plates to said piers;

removing said lift bracket assemblies whereby said slab is supported by said piers in the desired position.

2. A method of lifting and supporting slabs as set forth in claim 1 wherein the lift plates are raised and secured to engage the lower face of the slab prior to raising the slab.

3. A method of lifting and supporting slabs as set forth in claim 2 which includes the step of cutting off the top of the piers after they have been driven so that the top of the piers thus shortened will be below the level of the top of the slab after it has been raised.

4. A method of lifting and supporting structures as set forth in claim 3 wherein threaded rods are used to attach said lift plates below the slab and to releasably attach said pier driving assembly and lift bracket assembly above the slab.

5. A method of lifting and supporting slabs as set forth in claim 4 wherein said piers are driven by said pier driving assembly until the slab begins to rise, after which weights are placed on top of said pier driving assembly and the piers continue to be driven until said slab and said pier driving assembly rise.

6. A method of lifting and supporting slabs as set forth in claim 5 wherein the lift bracket assembly is comprised of a lift bracket which is bolted on the threaded rods through the slab to the lift plate, and a ram is employed to space apart said lift bracket and said pier and thereby raise said slab.

7. A method of lifting and supporting slabs as set forth in claim 6 which includes the step of inserting high strength grout between said lift plate and the lower face of said slab prior to driving the piers.

8. A method of lifting and supporting slabs as set forth in claim 7 wherein the access hole is cut by a series of three overlapping circular holes through the slab and the shape of the lift plate corresponds to the shape of the access hole.

9. A method of lifting and supporting slabs as set forth in claim 8 wherein the lift plate is secured to the pier by a weld.

* * * * *